US005625665A

United States Patent [19]

Fokkink et al.

[11] Patent Number: 5,625,665

[45] Date of Patent: Apr. 29, 1997

[54] X-RAY APPARATUS COMPRISING A FILTER

[75] Inventors: Lambertus G. J. Fokkink; Petrus W. J. Linders; Johanna A. M. Sondag-Huet-Horst; André R. De Wit; Rudolf Kemner, all of Eindhoven; Frans J. A. Berkers, Vessem, all of Netherlands

[73] Assignee: U.S. Philips Corporation, New York, N.Y.

[21] Appl. No.: 546,027

[22] Filed: Oct. 20, 1995

[30] Foreign Application Priority Data

Oct. 25, 1994 [EP] European Pat. Off. ..... 94203094

[51] Int. Cl.[6] ..... G21K 3/00

[52] U.S. Cl. ..... 378/156

[58] Field of Search ..... 378/145, 156, 378/158, 159, 157

[56] References Cited

U.S. PATENT DOCUMENTS 3,755,672 8/1973 Edholm et al. ..... 378/159 X
4,701,021 10/1987 Le Pesant et al. .
5,148,465 9/1992 Mulder et al. ..... 378/159 X

FOREIGN PATENT DOCUMENTS 2599886 12/1987 France .
2601493 1/1988 France ..... 378/159

*Primary Examiner*—David P. Porta
*Attorney, Agent, or Firm*—Jack D. Slobod

[57] ABSTRACT

An X-ray apparatus is provided with a filter (12) for limiting the dynamic range of an X-ray image formed on an X-ray detector (4) by exposure of an object (3), for example a patient to be examined, to X-rays (2). The filter (12) has filter elements (13) including one or more capillary tubes (13), one end of which communicates with a reservoir with an X-ray absorbing liquid. The adhesion of the X-ray absorbing liquid to the inner side of the capillary tubes can be adjusted by means of an electric voltage applied to an electrically conductive layer provided on the inner side of the capillary tubes (13). The degree of filling of the capillary tubes (13) with the X-ray absorbing liquid is adjusted by way of the electric voltage value. The X-ray absorption profile is adjusted within a very short period of time, for example within one second, by adjustment of the electric voltages applied to the capillary tubes (13).

19 Claims, 4 Drawing Sheets

X-RAY APPARATUS COMPRISING A FILTER

BACKGROUND OF THE INVENTION

1. Field of the Invention

The invention relates to an X-ray examination apparatus, comprising a X-ray source and an X-ray detector wherebetween there is arranged a filter which comprises a plurality of filter elements having an X-ray absorptivity which can be adjusted by controlling a quantity of X-ray absorbing liquid within individual filter elements.

2. Description of the Related Art

An X-ray examination apparatus of this kind is known from French Patent Application FR 2 599 886. The known X-ray apparatus comprises a filter for limiting the dynamic range of an X-ray image, being the interval between the extremes of the brightness values. An X-ray image is formed on the X-ray detector by arranging an object, for example a patient to be examined, between the X-ray source and the X-ray detector and by irradiating said object by means of X-rays emitted by the X-ray source. If no steps are taken, the dynamic range of the X-ray image may be large. On the one hand, for some parts of the object, for example lung tissue, the X-ray transmittance will be high whereas other parts of the object, for example bone tissue, can hardly be penetrated by X-rays. Lead shutters which are used to intercept pans of the X-ray beam emitted by the X-ray source in order to shield pans of the object to be examined from the X-rays are imaged with a uniform, very low brightness. Lead shutters are also used to prevent X-rays which do not pass through the object from reaching the X-ray detector, thus causing overexposures in the X-ray image. If no further steps are taken, therefore, an X-ray image is obtained with a large dynamic range whereas, for example medically relevant information in the X-ray image is contained in brightness variations in a much smaller dynamic range; because it is practically impossible to make small details of low contrast suitably visible in a rendition of such an X-ray image, such an X-ray image cannot be used very well for making a diagnosis. Furthermore, problems are encountered when such an X-ray image is picked up by means of an image intensifier pick-up chain. An image intensifier pick-up chain comprises an image intensifier tube for convening an incident X-ray image into a light image and a video camera for deriving an electronic image signal from the light image. From regions of very high or very low brightness in the X-ray image, regions of very high and very low brightness, respectively, are formed in the light image. If no further steps are taken, the dynamic range of the light image could be larger than the range of brightness values that can be handled by the video camera without causing disturbances in the electronic image signal.

In order to limit the dynamic range of the X-ray image, the known X-ray examination apparatus comprises a filter with filter elements provided with a bundle of parallel capillary tubes, each of which is connected, via a valve, to a reservoir containing an X-ray absorbing liquid which suitably wets the inner walls of the capillary tubes. In order to fill a capillary tube with the X-ray absorbing liquid, the valve of the relevant capillary tube is opened, after which the capillary tube is filled with the X-ray absorbing liquid by the capillary effect. Such a filled capillary tube has a high X-ray absorptivity for X-rays passing through such a filled capillary tube in a direction approximately parallel to its longitudinal direction. The valves are controlled so as to ensure that the amount of X-ray absorbing liquid in the capillary tubes is adjusted so that in parts of the X-ray beam which pass through parts of low absorptivity of the object filter elements are adjusted to a high X-ray absorptivity and that filter elements in parts of the X-ray beam which pass through parts of high absorptivity of the object, or are intercepted by a lead shutter, are adjusted to a low X-ray absorptivity.

In order to change the adjustment of the filter of the known X-ray examination apparatus it is necessary to empty tilled capillary tubes first. Therefore, use is made of a paramagnetic X-ray absorbing liquid which is removed from the capillary tubes by application of a magnetic field. After all capillary tubes have been emptied, the filter is adjusted anew by de, activation of the magnetic field and by subsequently opening valves of capillary tubes which are filled with the X-ray absorbing liquid for the new filter setting so as to adjust these tubes to a high X-ray absorptivity.

It is a drawback of the known filter that it is practically impossible to change the setting of the filter within a brief period of time, for example one second. Therefore, the known X-ray apparatus is not suitable for forming successive X-ray images at a high image rate when the setting of the filter is changed between the formation of successive X-ray images. Because it is necessary to empty all capillary tubes before the filter elements can be adjusted to new X-ray absorptivities and because the X-ray absorbing liquid suitably wets the inner wall of the capillary tube so that emptying requires a substantial period of time, i.e. several seconds or even tens of seconds, switching over the known filter is rather time-consuming. Moreover, it is not readily possible to make the capillary tube completely empty by application of the magnetic field, because a layer of X-ray absorbing liquid will adhere to the inner walls of the capillary tubes.

It is a further drawback of the known filter that the construction utilizing separate mechanical valves for each of the capillary tubes is rather complex.

SUMMARY OF THE INVENTION

It is inter alia an object of the invention to provide an X-ray apparatus which comprises a filter whose setting can be changed within a brief period of time.

It is a further object of the invention to avoid a complex mechanical construction of such a filter.

To this end, an X-ray examination apparatus in accordance with the invention is characterized in that it comprises an adjusting circuit for applying electric voltages to individual filter elements, and that the quantity of X-ray absorbing liquid in individual filter elements can be controlled on the basis of said electric voltages.

The relative quantity of liquid is to be understood to mean herein the quantity of liquid in such a filter element relative to the quantity of liquid in the relevant filter element when it is completely filled with liquid. The electric voltage applied to a filter element influences the adhesion of the X-ray absorbing liquid to the inner side of the filter element and this adhesion determines the degree of filling of the filter element with the X-ray absorbing liquid. The relative quantity of X-ray absorbing liquid in the individual filter elements is controlled on the basis of the electric voltages applied to individual filter elements. For example, in the case of a first value of the electric voltage the adhesion of the X-ray absorbing liquid to the inner side is increased and the relevant filter element is filled with the X-ray absorbing liquid from a reservoir. In the case of a second value of the electric voltage, the adhesion is decreased and the X-ray absorbing liquid is drained from the filter element to the reservoir. Filter elements are adjusted to a high X-ray absorptivity by filling with an X-ray absorbing liquid; they are adjusted to a low X-ray absorptivity by emptying them.

Changing the electric voltages applied to the individual filter element does not require much time (at most a few tenths of a second) and the relative quantity of X-ray absorbing liquid in the filter elements has been changed already briefly after changing of the electric voltages, so that changing the setting of the filter requires little time (less than one or a few seconds). Furthermore, it is not necessary to empty all filter elements between two adjustments of the filter.

It is not necessary either to provide the filter with a complex mechanical system of valves, because the degree of filling of the filter elements is controlled by means of the electric voltages.

The X-ray absorbing liquid is formed, for example by an aqueous solution of a lead salt. A solution of a uranium salt is also a suitable X-ray absorbing liquid for use in accordance with the invention.

Depending on the materials used for the filter elements and for the X-ray absorbing liquid, the effect of the electric voltage on the adhesion has different causes: for example, because surfaces of an electric double layer in the X-ray absorbing liquid are influenced near the inner side of each filter element, or because under the influence of the electric voltage oxidation reduction reactions occur, so that such an electric double layer is influenced. It may also be that under the influence of the electric voltage absorption-desorption reactions occur which switch the surface of the inner side between hydrophillic and hydrophobic.

The electric voltages applied to the individual filter elements are selected, for example for a filter setting which is specific of the type of X-ray image to be formed; for an X-ray image of the heart and the coronary vessels of a patient, for example a filter setting is required which deviates from that required for an X-ray image of the vascular structure of limbs. The electric voltages can also be derived from settings of the X-ray source, such as the settings of the high voltage and the anode current with which the X-ray source operates, in order to adjust the filter on the basis of the setting of the X-ray source.

A preferred embodiment of an X-ray examination apparatus in accordance with the invention is characterized in that the adjusting circuit is arranged to adjust the filter elements to X-ray absorptivities for which brightness values of an X-ray image incident on the X-ray detector are within a predetermined range, said X-ray image being formed by irradiating an object by means of an X-ray beam emitted by the X-ray source.

When the filter setting is suitably chosen, the dynamic range of the X-ray image will remain within a predetermined range which is not much larger than the range of brightness values of medically relevant image information in the X-ray image. Small details of little contrast in this X-ray image can then be better reproduced, so that the X-ray image represents a better medical diagnostic tool. For example, when an X-ray detector is used in the form of an image intensifier pick-up chain including a video camera, by a suitable setting of the filter it can be achieved that the brightness values of the X-ray image are within a range which can be processed into an electronic image signal by the image intensifier pick-up chain without disturbances. Via this electronic image signal, the image information can also be displayed in a disturbance-free manner, for example on a monitor.

A further preferred embodiment of an X-ray examination apparatus in accordance with the invention is characterized in that the adjusting circuit is arranged to adjust the filter elements on the basis of brightness values of an X-ray image picked up by the X-ray detector.

By adjusting the filter on the basis of the X-ray image, it is automatically adjusted in conformity with the type of X-ray exposure and the exposure conditions. To this end, the adjusting circuit receives a signal from the X-ray detector which represents brightness values of the X-ray image; for example, such a signal is an image information signal which contains image information and/or brightness values of the X-ray image formed on the X-ray detector. This image information signal contains notably information as regards the regions in which the image brightness is beyond a desired dynamic range; on the basis of this information, the electric voltages applied to the individual filter elements are adjusted so that X-ray absorptivities of the filter elements are adjusted to values for which the entire image brightness of the X-ray image is within said desired dynamic range.

Changing the setting of the filter on the basis of image information within a brief period of time, for example in less than one second, counteracts disturbances in the X-ray image due to motions of or in the patient. Should motion of or in a patient to be examined occur, for example due to respiration or heart beat, adverse effects on the image quality of the X-ray image due to such motions are avoided in that the filter setting follows the motion automatically and in time.

A further preferred embodiment of an X-ray examination apparatus in accordance with the invention is characterized in that individual filter elements are provided with one or more capillary tubes and that an output of the adjusting circuit is coupled to inner sides of the capillary tubes, in order to output said electric voltages.

A small variation of the electric voltages applied to the inner side of such capillary tubes by the adjusting circuit already results in a large and fast change of the degree of filling of these capillary tubes with the X-ray absorbing liquid. For example, an empty capillary tube having a length of a few cm can first be filled completely and then completely emptied again within a few seconds by varying the electric voltage by approximately one volt. Individual filter elements are provided with one or more capillary tubes which communicate, via one end, with the reservoir containing the X-ray absorbing liquid. The filter is constructed, for example in such a manner that the capillary tubes extend approximately parallel to the direction of the X-ray beam; a uniform spatial resolution of the spatial X-ray absorption pattern is thus achieved across the cross-section of the X-ray beam. Alternatively, the filter can be constructed so that the capillary tubes extend approximately parallel to one another; it is thus achieved that when the X-ray beam diverges substantially all X-rays pass at least for a part through a capillary tube so that X-rays cannot pass between two tubes substantially without being attenuated.

The X-ray absorptivity of a filter element can be adjusted by adjusting the relative quantity of X-my absorbing liquid in capillary tubes of the relevant filter element by way of the electric voltage value. Another possibility for adjusting the X-ray absorptivity of a filter element provided with a group of several capillary tubes consists in filling a fraction of the capillary tubes of the group substantially completely with the X-ray absorbing liquid by selectively applying electric voltages to the capillary tubes of the relevant fraction and by leaving the remaining capillary tubes of the group empty or by filling them with the buffer liquid. The X-ray absorptivity of the filter element is then approximately directly proportional to the fraction of filled capillary tubes, so that the X-ray absorptivity can be adjusted by adjustment of the fraction of filled capillary tubes of the relevant group. X-rays for medical diagnostic use which pass over a length of 10 mm or more through a solution of a uranium salt, notably uranylchloride, in water filled capillary tubes, are even substantially completely absorbed. When a uranium salt such as a uranylchloride solution is used as the X-ray absorbing liquid, therefore, the filter is also suitable for shielding parts of the patient to be examined from the X-ray beam, so that unnecessary exposure to X-rays, being detrimental to living tissue, is further reduced without degrading the quality of the X-ray image.

A further preferred embodiment of an X-ray examination apparatus in accordance with the invention is characterized in that at least a part of the inner side of the capillary tubes is covered by an electrically conductive layer.

The capillary tubes are preferably made of glass, because glass can suitably withstand X-rays, is also suitable to form capillary tubes having a small diameter of, for example 200 μm, but need not be electrically conductive. The electric voltage is applied to the electrically conductive layer which at least partly covers the inner side. The electrically conductive layer contains a material such as gold, silver, platinum, copper, tungsten, graphite or doped gallium arsenide or a combination thereof, which is electrically conductive but also suitably capable of resisting attack by chemical reactions with the X-ray absorbing liquid under the influence of the applied electric voltage or not.

A further preferred embodiment of an X-ray examination apparatus in accordance with the invention is characterized in that the electrically conductive layer is covered by a coating layer with which the X-ray absorbing liquid encloses a contact angle which varies, as a function of the electric voltage applied to the electrically conductive layer, in a range of values which includes the contact angle value 90°.

In a capillary tube filled with the X-ray absorbing liquid the liquid surface encloses an angle relative to the inner side of the tube; this angle, referred to as the contact angle, is a measure of the adhesion of the X-ray absorbing liquid. The range of the contact angle as a function of the applied voltage is rendered independent of the material of the conductive layer by covering the electrically conductive layer by means of the coating layer. As a result, the composition of the electrically conductive layer can be optimally chosen, irrespective of the desired contact angle range. The material of the coating layer is preferably chosen so that for a first value of the electric voltage the contact angle between the X-ray absorbing liquid and the electrically conductive layer on the inner side is less than 90° and that for a second value said contact value is larger than 90°. Capillary tubes whereto an electric voltage of the first value is applied are filled with an X-ray absorbing liquid to a substantial degree which is dependent on said first voltage value, and capillary tubes whereto an electric voltage of said second value is applied are not or only insignificantly filled with the X-ray absorbing liquid. Said second electric voltage value, for example equals the electric voltage of a reference electrode in the reservoir for the X-ray absorbing liquid.

A further preferred embodiment of an X-ray examination apparatus in accordance with the invention is characterized in that the X-ray absorbing liquid contains an aqueous solution of an X-ray absorbing material and that the coating layer contains a material from the group of ferrocene thiol and alkane thiols substituted with a CN, Cl or $CH_3$ group or combinations thereof.

Using such a coating layer containing thiol, the contact angle can be switched between values higher and lower than 90° when an aqueous solution is used as the X-ray absorbing liquid. These thiols are notably suitable for covering a gold layer, because the sulphur of the thiol suitably binds with gold. When a quantity of thiol is added to the X-ray absorbing liquid, defects in the coating layer, for example caused by decomposition of the thiol due to absorption of X-rays, will be automatically repaired because the coating layer takes up thiol from the X-ray absorbing liquid.

When a platinum layer is used as the electrically conductive layer, mercury is a suitable material for the coating layer. An electrically conductive graphite layer has the property that lead and uranium salts dissolved in water result in a contact angle which can be switched between values higher and lower than 90° by means of an electric voltage, so that the graphite layer need not be covered by a separate coating layer.

The viscosity and the adhesion properties of the X-ray absorbing liquid are dependent on the temperature of the filter to a given degree; this temperature could rise, for example due to the absorption of X-rays in the X-ray absorbing liquid, if the filter is exposed to X-rays and no further steps are taken. In order to stabilize the adjusting behavior of the filter, it is preferably provided with a thermostatic control system which keeps the temperature of the filter, and notably of the X-ray absorbing liquid, substantially constant.

These and other aspects of the invention will be apparent from and elucidated with reference to the embodiments described hereinafter.

DETAILED DESCRIPTION OF THE PREFERRED EMBODIMENTS

Figure 1:
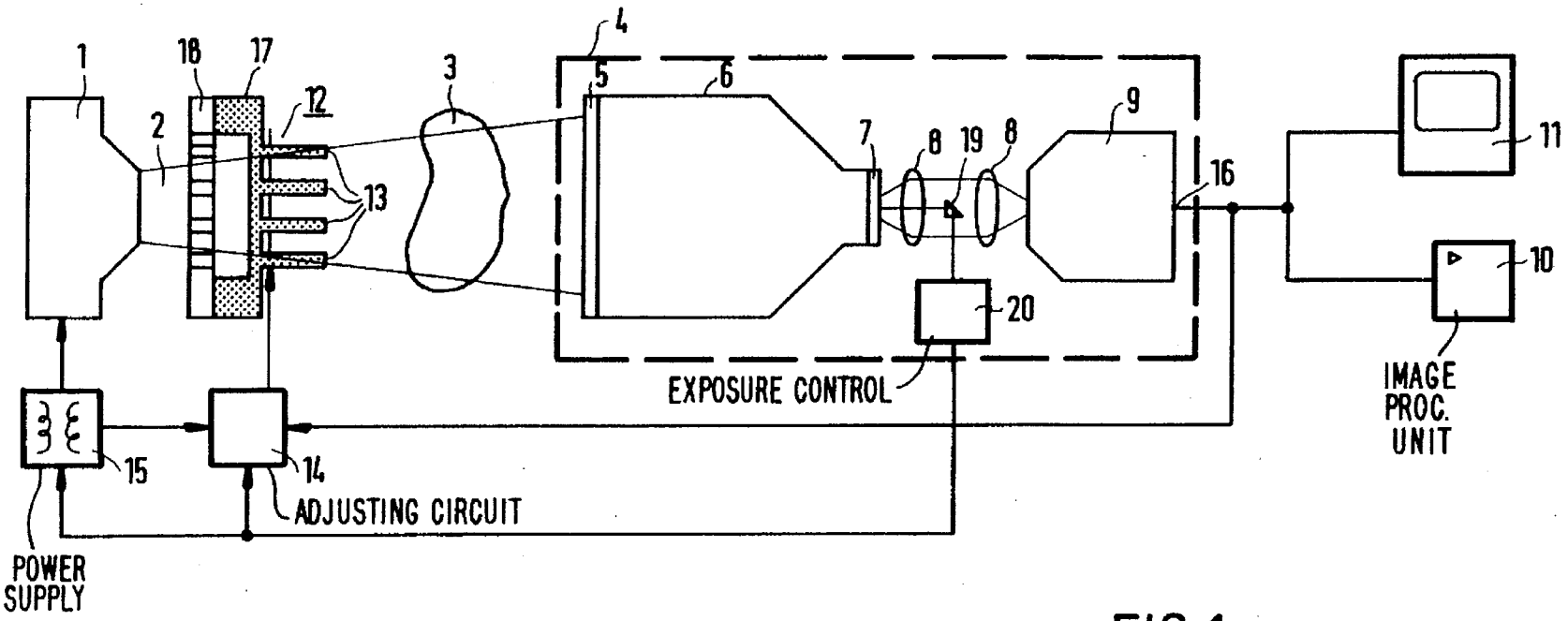
FIG. 1 shows diagrammatically an X-ray examination apparatus comprising a filter in accordance with the invention.

FIG. 1 shows diagrammatically an X-ray examination apparatus comprising a filter in accordance with the invention. The X-ray source 1 emits an X-ray beam 2 whereto an object 3, for example a patient to be examined, is exposed. As a result of local differences in the absorption of X-rays in the object 3 an X-ray image is formed on the X-ray detector 4 which is in this case an image intensifier pick-up chain. The X-ray image is formed on the entrance screen 5 of the X-ray intensifier 6 and is converted into a light image on the exit window 7, which light image is imaged on a video camera 9 by means of a lens system 8. The video camera 9 forms an electronic image signal from the light image. The electronic image signal is applied, for example for further processing, to an image processing unit 10 or to a monitor 11 on which the image information in the X-ray image is displayed.

Between the X-ray source 1 and the object 3 there is arranged the filter 12 for local attenuation of the X-ray beam 12 by means of various filter elements 13 in the form of capillary tubes whose X-ray absorptivity can be adjusted by application of electric voltages to the inner side of the capillary tubes by means of an adjusting circuit 14. The electric voltages are adjusted by the adjusting circuit 14 on the basis of, for example brightness values of the X-ray image and/or on the basis of the setting of the X-ray source; to this end, the adjusting circuit is coupled to the power supply 15 of the X-ray source and to the output terminal 16 of the video camera 9.

Part of the light of the exit window is guided, by way of a splitting prism 19, to an exposure control system 20 which derives a control signal from the light image in order to control the high-voltage supply on the basis of image information of the image on the exit window. In order to receive image information of the image on the exit window 7, the adjusting circuit 14 of the filter 12 is coupled to the exposure control system 20, so that the filter 12 can be adjusted on the basis of the image on the exit window 7.

The filter is constructed, for example in such a manner that the capillary tubes extend approximately parallel to the direction of the X-ray beam 2; a uniform spatial resolution of the spatial X-ray absorption pattern is thus achieved across the cross-section of the X-ray beam. Alternatively, the filter can also be 6constructed in such a manner that the capillary tubes extend approximately parallel to one another; when the X-ray beam diverges, it is thus achieved that substantially all X-rays pass at least partly through a capillary tube, so that X-rays cannot pass between two tubes without being attenuated. The adjusting circuit applies electric voltages to the inner sides of the capillary tubes so as to influence the adhesion of the X-ray absorbing liquid to the inner sides. In order to adjust a filter element to a high X-ray absorptivity, an electric voltage of the first value is applied to the inner side of the capillary tubes of the relevant filter element by the adjusting circuit 14, the relevant capillary tubes then being filled with the X-ray absorbing liquid from the reservoir 17 by strong adhesion of the X-ray absorbing liquid to the inner side. In order to adjust a filter element to a low X-ray absorptivity, the adjusting circuit 14 applies an electric voltage of the second value, for example equal to the potential of a reference electrode (for example, a standard calomel electrode) in the X-ray absorbing liquid, to the inner side of the capillary tubes of the relevant filter element, the X-ray absorbing liquid then exhibiting poor adhesion to the relevant capillary tubes, so that these capillary tubes are not filled with the X-ray absorbing liquid from the reservoir 17. A filter element may also comprise a group of several capillary tubes and the X-ray absorptivity of the filter element is then adjustable by adjustment of the fraction of capillary tubes of said group filled with the X-ray absorbing liquid by application of an electric voltage of the first value to the capillary tubes of the fraction and by application of the second voltage value to the remaining capillary tubes of the group. The adjusting circuit adjusts the filter elements to X-ray absorptivities for which the brightness values of the X-ray image are within a predetermined range, for example in conformity with the range of brightness values of the light image that can be handled by the video camera 9 without introducing disturbances in the electronic image signal. Filter elements which are traversed by a part of the X-ray beam which is strongly attenuated by the object are adjusted to a low X-ray absorptivity and filter elements which are traversed by a part of the X-ray beam which is transmitted well by the object are adjusted to a high X-ray absorptivity.

The filter 12 is provided with a compensation filter 18 which is arranged in the path of the X-ray beam 2. The compensation filter has an X-ray absorptivity with a spatial variation which ensures that when the capillary tubes are empty, X-rays passing through the filter 12 with the compensation filter 18 are all attenuated to approximately the same extent. In order to prevent shifting of the compensation filter 18 relative to the filter 12, the compensation filter 18 is preferably mechanically rigidly connected to the filter 12. As a result of the use of the compensation filter 18, the structure of the filter 12 will not introduce disturbances in the X-ray image in as far as it absorbs X-rays other than by the X-ray absorbing liquid in the capillary robes.

Figure 2:
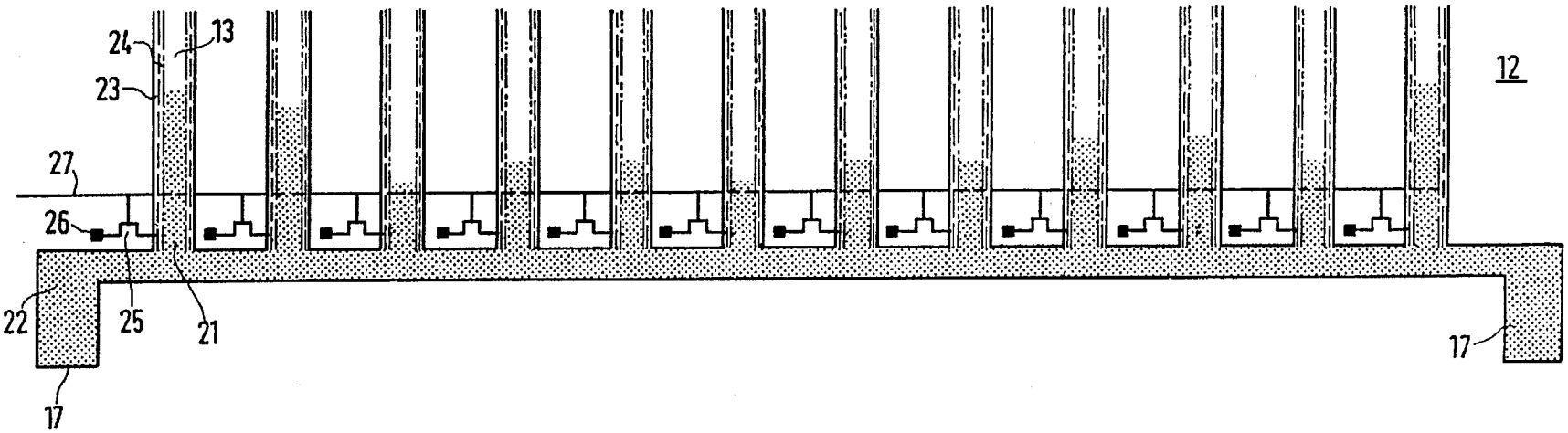
FIG. 2 is a diagrammatic sectional view of an embodiment of a filter of the X-ray examination apparatus of FIG. 1.

FIG. 2 is a diagrammatic sectional view of an embodiment of a filter of the X-ray examination apparatus shown in FIG. 1. The filter 12 comprises a number of filter elements 13, each of which is formed by a capillary tube 13. A dozen capillary tubes are shown by way of example; however, in a practical embodiment a filter for an X-ray examination apparatus in accordance with the invention may comprise a very large number of capillary tubes, for example 40,000 in an 200×200 matrix array of 5 cm×5 cm. Each of the capillary tubes 13 communicates, by way of an end 21, with the reservoir 17 for the X-ray absorbing liquid 22. The X-ray absorbing liquid 22 consists, for example of an aqueous solution of a lead salt, such as lead perchlorate, lead nitrate, lead chlorate-hydrate, lead acetate-trihydrate or lead dithionate. A solution of uranium salts, such as uranylchloride, uranium tetrabromide or uranium tetrachloride solved in water also constitutes a suitable X-ray absorbing liquid 22 in the context of the present invention. The electric voltages preferably amount to at the most one volt DC, so that undesirable development of gas due to electrolysis of the aqueous solution constituting the X-ray absorbing liquid 22 is avoided. Alternativily, decomposition of the water used as the solvent is counteracted by the use of a high alternating voltage of some kV at a frequency of from some tens of Hz to some kHz.

An approximately tenfold attenuation of the X-rays passing through the capillary tubes is achieved by filling the capillary tubes with a substantially saturated aqueous solution of lead nitrate over a length of approximately 12 mm, said filling being completed within approximately 0.2 s. In order to obtain the same attenuation when lead perchlorate is used instead of lead nitrate, with a maximum dissolved quantity, the capillary tubes need be filled only over a length of 1.6 mm and the time required for filling the capillary tubes will be much shorter than one second, for example a few milliseconds.

In as far as capillary tubes have not been filled or will not be filled with the X-ray absorbing liquid 22, the capillary tubes can be filled with an X-ray transmitting buffer liquid which does not mix with the X-ray absorbing liquid. The buffer liquid is preferably chosen so that the contact angle, also being dependent on the materials of the X-ray absorbing liquid, on the inner side of the capillary and on the buffer liquid, varies in a range which includes an angle of 90° by varying the electric voltage applied to the inner side of the capillary between approximately 0 and 1 volt DC or between 0 and a few kV AC with a frequency of between some tens of Hz and a few kHz. By selecting a buffer liquid having a density which is approximately equal to that of the X-ray absorbing liquid 22, it is ensured that the filling of the capillary tubes with the X-ray absorbing liquid 22 is substantially independent of gravity and hence independent of the spatial orientation of the filter.

The inner side of the capillary tubes is provided with an electrically conductive layer 23, for example a gold, silver or platinum layer, which is covered by a coating layer 24 of, for example ferrocene thiol or an alkane thiol. The electrically conductive layer 23 on the inner side of each of the capillary tubes is coupled, by way of a switching element 25 such as a field effect transistor, to a voltage lead 26. In order to apply the electric voltage on the voltage lead 26 to the electrically conductive layer of a capillary tube, the relevant switching element 25 is closed by way of a signal supplied via a control lead 27. The adhesion to the inner side of the capillary tubes is dependent on the electric voltage value on the electrically conductive layer provided on the inner side of the capillary tubes; consequently, the degree of filling of each of the capillary tubes with the X-ray absorbing liquid 22 can be adjusted by means of said electric voltage value. By applying different electric voltage values to individual capillary tubes, the X-ray absorptivity of the filter can be changed over short distances, for example at a millimeter scale. In order to change the setting of the filter, applied electric voltage values are changed within approximately 0.12 s and, because of the changed electric voltage values, the degree of filling of the capillary tubes changes in approximately a few tenths of a second.

Figure 3:
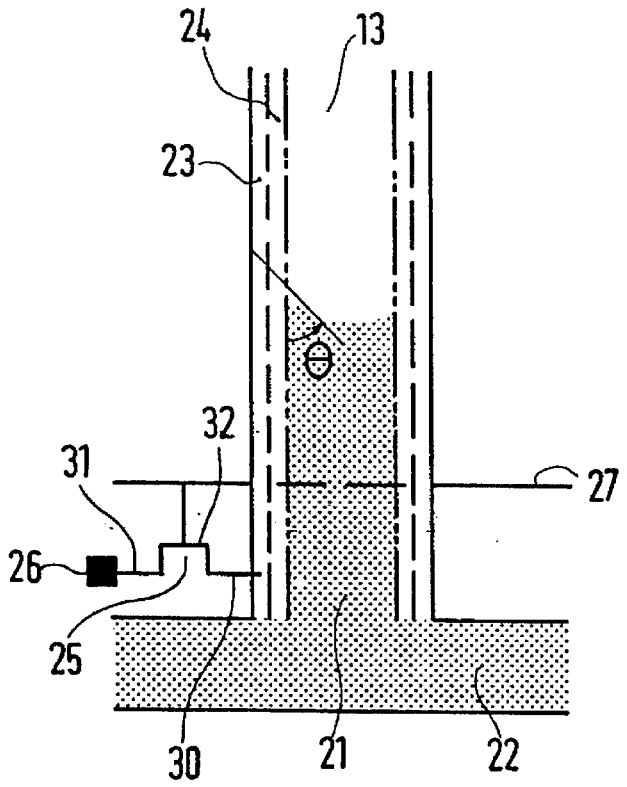
FIG. 3 is a diagrammatic sectional view of a filter element of the filter of FIG. 2 filled with an X-ray absorbing liquid.

FIG. 3 is a diagrammatic sectional view of a filter element of the filter of FIG. 2 filled with the X-ray absorbing liquid 22. The electrically conductive layer 23 of the capillary tube 13 is coupled to a drain contact 30 of the field effect transistor 25 which acts as the switching element and whose source contact 31 is coupled to the voltage lead 26. The field effect transistor 25 is turned on, i.e. the switching element is closed, by a control voltage which is applied to a gate contact 32 of the field effect transistor 25 via the control lead 27. The electrically conductive layer 23 is connected to the electric voltage of the voltage lead 26 by the closing of the switching element. When the voltage lead is connected to said first electric voltage value, the contact angle θ of the X-ray absorbing liquid 22 relative to the coating layer 24 assumes a value which is less than 90° and the relevant capillary tube is filled with the X-ray absorbing liquid to an extent which is dependent on the value of the electric voltage.

Figure 4:
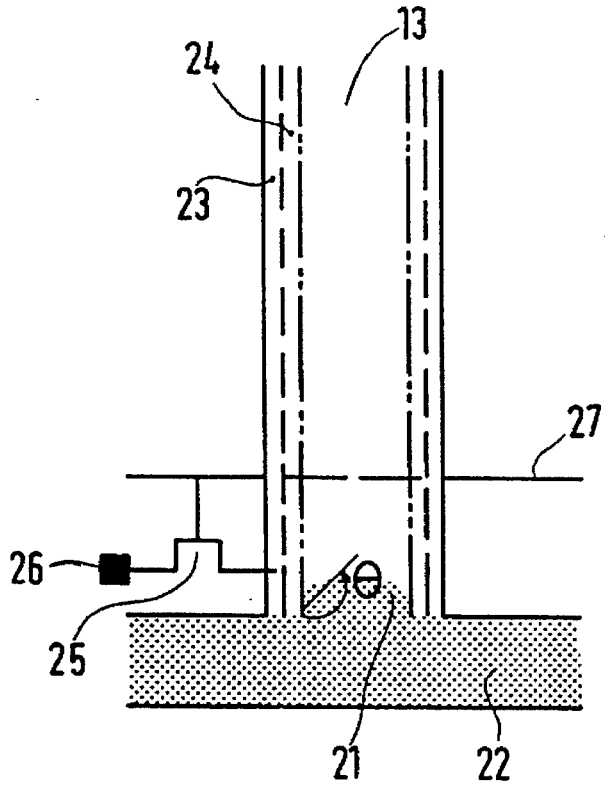
FIG. 4 is a diagrammatic sectional view of a filter element of the filter of FIG. 2 which is not filled with an X-ray absorbing liquid.

FIG. 4 is a diagrammatic sectional view of a filter element of the filter of FIG. 2 which is not filled with the X-ray absorbing liquid. The coating layer and the X-ray absorbing liquid are preferably chosen so that in the absence of an electric voltage, i.e. voltage value equal to the potential of the reference electrode in the X-ray absorbing liquid, the value of the contact angle exceeds 90°. By closing the switching element 25 when the potential of the voltage lead 26 is the same as that of the reference electrode, the adhesion of the X-ray absorbing liquid to the coating layer is adjusted, the contact angle θ then being larger than 90°; the X-ray absorbing liquid then hardly enters the capillary tube 13 or even does not enter it at all.

Figure 5:
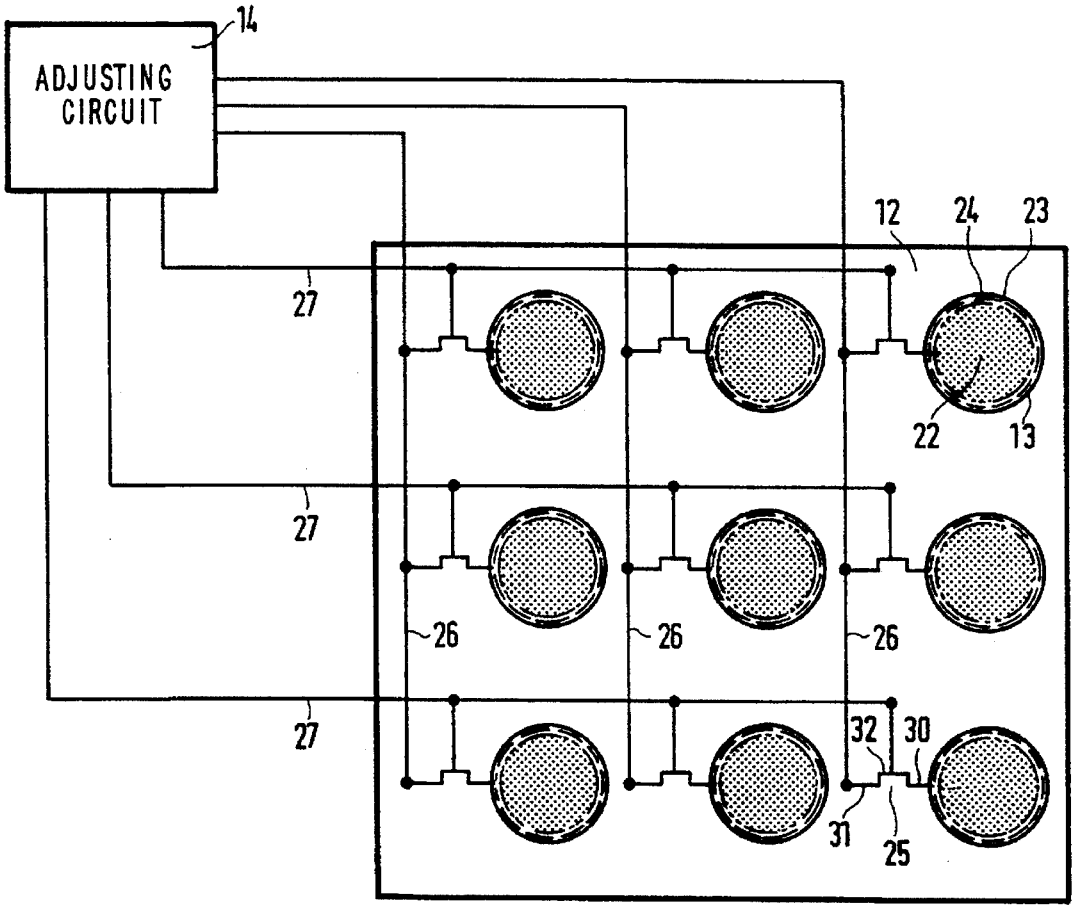
FIG. 5 is a diagrammatic plan view of the filter of the X-ray examination apparatus shown in FIG. 1.

FIG. 5 is a diagrammatic plan view of the filter of the X-ray examination apparatus shown in FIG. 1. By way of example, a filter is shown which comprises 3×3 capillary tubes in a square matrix array with rows and columns. In practice there may be provided a filter which comprises a very large number of capillary tubes, for example 200×200 tubes, and instead of a square matrix any other array can be used. The capillary tubes are preferably arranged in a configuration in which a densest packing is achieved; this means a square configuration when the capillary tubes have a more or less square cross-section or a rhombic (triangular) array when capillary tubes having an approximately round cross-section are used. Use can also be made of a hexagonal configuration which can be comparatively simply realized in a fault-free manner. Each of the capillary tubes 13 is coupled, by way of the electrically conductive layer 23, to the drain contact 30 of a field effect transistor 25 which is coupled to a voltage lead 26 by way of its source contact. For each of the rows of capillary tubes 13 there are provided control leads 27 which control the field effect transistors by applying, by way of a control lead 27, a control voltage to the gate contacts 32 of the field effect transistors in the controlled row. In order to apply an electric voltage to the inner side, notably to the electrically conductive layer 23 of a capillary tube, the adjusting circuit 14 energizes, by way of a suitable electric voltage value, the voltage lead coupled to the relevant capillary tube. The adjusting circuit applies the control voltage to the control lead 27 of the relevant capillary tube, said control voltage being applied to the gate contact 32 of the relevant capillary tube so that the field effect transistor is turned on and the electric voltage value on the voltage lead is applied to the electrically conductive layer on the inner side of the capillary tube. After a short period of time the control voltage is switched off, so that the field effect transistors in the controlled row are electrically isolated and hence the voltage on the voltage lead is switched off. The relevant capillary tube, then being electrically decoupled from the control and voltage leads, retains the applied voltage. By successively applying a voltage column-by-column to voltage leads and control voltages to voltage leads for the rows for which capillary tubes are activated within the relevant column, it is achieved that desired electric voltages are applied to the capillary tubes or filter elements of the entire matrix in order to adjust the filter.

We claim:

1. An X-ray examination apparatus, comprising an X-ray source, an X-ray detector, a filter arranged therebetween which comprises a plurality of filter elements having an X-ray absorptivity which can be adjusted by controlling a quantity of X-ray absorbing liquid within individual ones of the filter elements, and an adjusting circuit for applying electric voltages to the individual ones of the filter elements, the quantity of X-ray absorbing liquid in the individual ones of the filter elements being controllable in response to said electric voltages.

2. An X-ray examination apparatus as claimed in claim 1, wherein the adjusting circuit is arranged to adjust the filter elements to X-ray absorptivities for which brightness values of an X-ray image incident on the X-ray detector are within a predetermined range, said X-ray image being formed by irradiating an object by means of an X-ray beam emitted by the X-ray source.

3. An X-ray examination apparatus as claimed in claim 1, wherein the adjusting circuit is arranged to adjust the filter elements on the basis of brightness values of an X-ray image picked up by the X-ray detector.

4. An X-ray examination apparatus as claimed in claim 1, wherein individual one of the filter elements are provided with one or more capillary tubes and that an output of the adjusting circuit is coupled to inner sides of the capillary tubes in order to output said electric voltages.

5. An X-ray examination apparatus as claimed in claim 4, wherein least a part of the inner side of the capillary tubes is covered by an electrically conductive layer.

6. An X-ray examination apparatus as claimed in claim 5, wherein the electrically conductive layer is covered by a coating layer with which the X-ray absorbing liquid encloses a contact angle which varies, as a function of the electric voltage applied to the electrically conductive layer, in a range of values which includes the contact angle value 90°.

7. An X-ray examination apparatus as claimed in claim 6, the X-ray absorbing liquid contains an aqueous solution of an X-ray absorbing material and that the coating layer contains a material from the group of ferrocene thiol and alkane thiols substituted with a CN, Cl or $CH_3$ group or combinations thereof.

8. An X-ray examination apparatus as claimed in claim 2, wherein the adjusting circuit is arranged to adjust the filter elements on the basis of brightness values of an X-ray image picked up by the X-ray detector.

9. An X-ray examination apparatus as claimed in claim 2, wherein individual ones of the filter elements are provided with one or more capillary tubes and that an output of the adjusting circuit is coupled to inner sides of the capillary tubes in order to output said electric voltages.

10. An X-ray examination apparatus as claimed in claim 3, wherein individual ones of the filter elements are provided with one or more capillary tubes and that an output of the adjusting circuit is coupled to inner sides of the capillary tubes in order to output said electric voltages.

11. An X-ray examination apparatus as claimed in claim 8, wherein individual ones of the filter elements are provided with one or more capillary tubes and that an output of the adjusting circuit is coupled to inner sides of the capillary tubes in order to output said electric voltages.

12. An X-ray examination apparatus as claimed in claim 9, wherein at least a part of the inner side of the capillary tubes is covered by an electrically conductive layer.

13. An X-ray examination apparatus as claimed in claim 10, wherein at least a part of the inner side of the capillary tubes is covered by an electrically conductive layer.

14. An X-ray examination apparatus as claimed in claim 11, wherein at least a part of the inner side of the capillary tubes is covered by an electrically conductive layer.

15. An X-ray examination apparatus as claimed in claim 12, wherein the electrically conductive layer is covered by a coating layer with which the X-ray absorbing liquid encloses a contact angle which varies, as a function of the electric voltage applied to the electrically conductive layer, in a range of values which includes the contact angle value 90°.

16. An X-ray examination apparatus as claimed in claim 13, wherein the electrically conductive layer is covered by a coating layer with which the X-ray absorbing liquid encloses a contact angle which varies, as a function of the electric voltage applied to the electrically conductive layer, in a range of values which includes the contact angle value 90°.

17. An X-ray examination apparatus as claimed in claim 14, wherein the electrically conductive layer is covered by a coating layer with which the X-ray absorbing liquid encloses a contact angle which varies, as a function of the electric voltage applied to the electrically conductive layer, in a range of values which includes the contact angle value 90°.

18. An X-ray examination apparatus as claimed in claim 16, wherein the X-ray absorbing liquid contains an aqueous solution of an X-ray absorbing material and that the coating layer contains a material from the group of ferrocene thiol and alkane thiols substituted with a CN, Cl or $CH_3$ group or combinations thereof.

19. An X-ray examination apparatus as claimed in claim 17, wherein the X-ray absorbing liquid contains an aqueous solution of an X-ray absorbing material and that the coating layer contains a material from the group of ferrocene thiol and alkane thiols substituted with a CN, Cl or $CH_3$ group or combinations thereof.

* * * * *